United States Patent [19]

LeMasson

[11] 4,197,810

[45] Apr. 15, 1980

[54] INVENTORY BOARD

[76] Inventor: Jacques C. LeMasson, 518 E. 80th St., New York, N.Y. 10021

[21] Appl. No.: 909,028

[22] Filed: May 24, 1978

[51] Int. Cl.[2] ..... G09F 9/00

[52] U.S. Cl. ..... 116/323; 116/318

[58] Field of Search ..... 116/135, 321, 323, 315, 116/318; 40/374, 375, 490, 611, 525

[56] References Cited

U.S. PATENT DOCUMENTS

| | | | |
|---|---|---|---|
| 163,302 | 5/1875 | Dike | 116/321 |
| 1,090,332 | 3/1914 | Morden | 40/374 |
| 1,268,613 | 6/1918 | Radebaugh | 116/323 X |
| 1,458,100 | 6/1923 | Knopf | 116/321 X |
| 1,964,484 | 6/1934 | Schroeder | 40/611 |
| 2,703,548 | 3/1955 | Mackintosh | 116/135 |
| 3,224,128 | 12/1965 | Steward | 40/525 |
| 3,522,666 | 8/1970 | Sarthoy | 35/24 A |
| 3,564,731 | 2/1971 | Weller | 35/24 B |
| 3,584,597 | 6/1971 | Simmons | 116/135 X |
| 3,778,914 | 12/1973 | Janssen | 40/374 |
| 3,943,646 | 3/1976 | Branham | 40/611 |

*Primary Examiner*—Daniel M. Yasich

*Attorney, Agent, or Firm*—Howard I. Podell

[57] ABSTRACT

An inventory board having tracks with marker strips slidable along the track to indicate the quantities of each item to be inventoried. An inventory marker scale is located to calibrate the marker strips. A margin adjacent to each of the sets of strips, tracks and scales is provided for labels to identify the individual product, brand and size that is being inventoried. The marker strips are each formed with a shaped tongue that is slidably engaged with an undercut track on the board.

4 Claims, 4 Drawing Figures

INVENTORY BOARD

BACKGROUND OF THE INVENTION

I have invented a new and novel inventory board. My inventory board will permit the user to conveniently study the quantities of an item on hand compared with the intended inventory as well as with a marking scale so that the user can make suitable preparations to maintain inventory at the desired levels.

Prior art references known at the time of preparation of this application include the following U.S. Pat. Nos. 3,999,041; 3,984,657; 3,933,305; 3,937,929; 3,711,014; 3,712,974; 3,224,128; 3,995,387; 3,583,358; 3,596,388; 3,522,666; and 3,290,797.

BRIEF DESCRIPTION OF THE INVENTION

My invention utilizes a board on which a plurality of tracks each hold inventory marker strips which can be slid in and out of a housing adjacent an item-identifying margin. An inventory marker scale is also provided between adjacent tracks so that actual numerical quantities associated with the marker strips can be directly indicated. The item identifying margin can be covered with a suitable label. The labels have preferably three categories for product, brand and size identification. The labels can be provided in full sheets with a number of categories equal to the number of groups of markers. Two marker strips can be used for each category brand and size, namely an actual inventory track and an intended minimum or maximum inventory track.

BRIEF DESCRIPTION OF THE FIGURES

My invention can be understood in view of the accompanying figures.

DETAILED DESCRIPTION OF THE EMBODIMENTS

Figure 1:
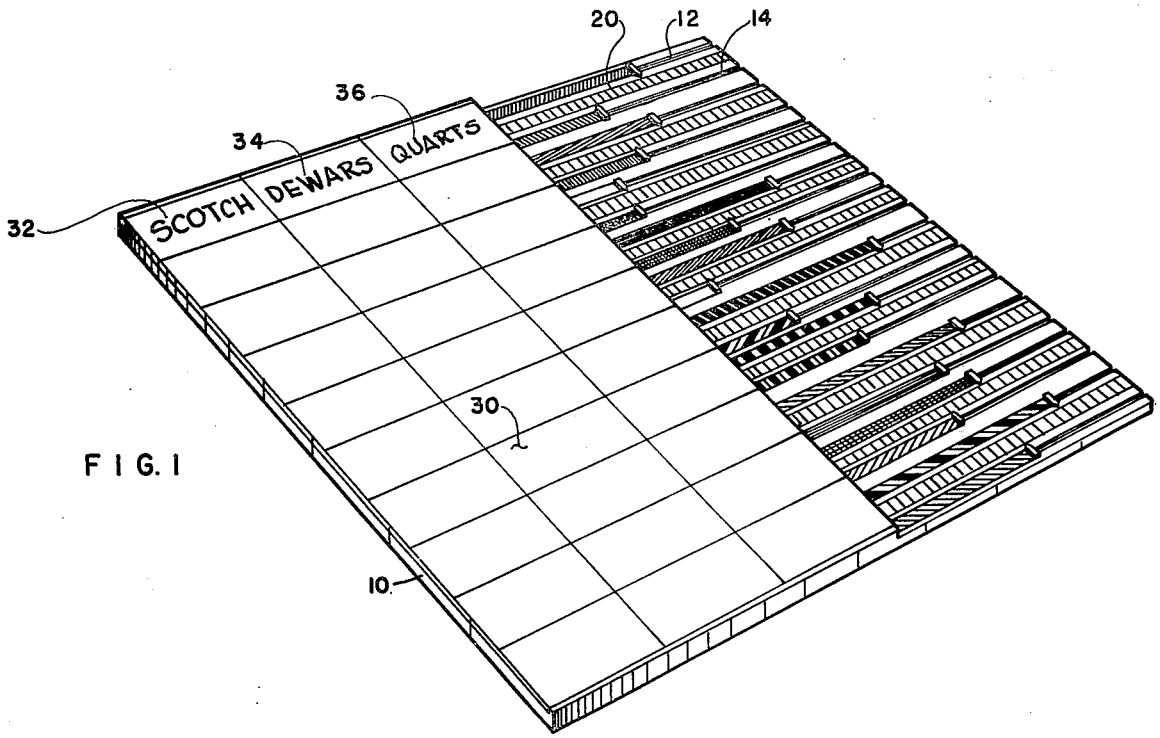
FIG. 1 is a perspective view of the device.
Figure 2:
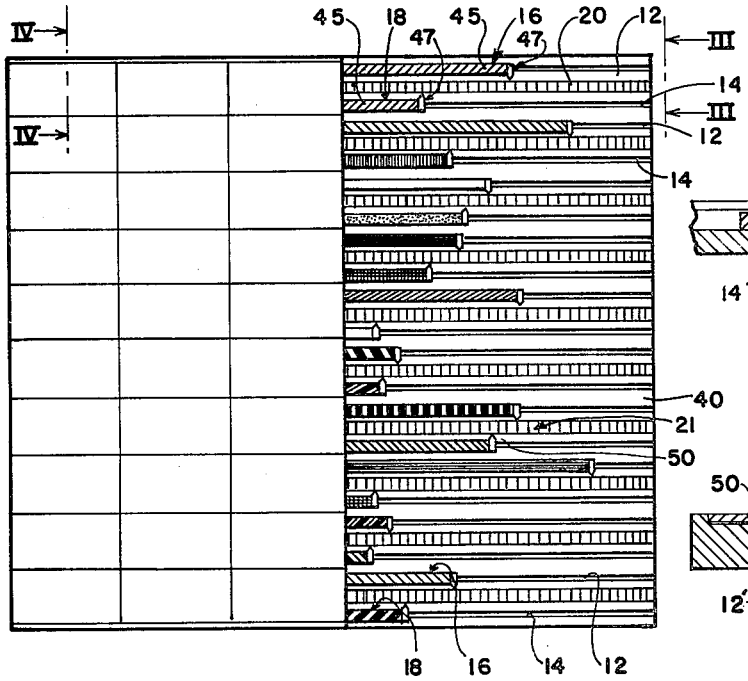
FIG. 2 is a plan view of the device.
Figure 3:
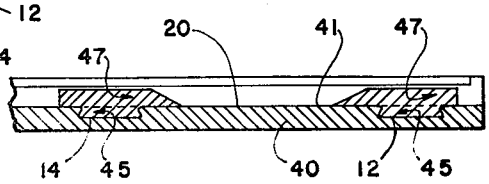
FIG. 3 is a sectional view of a portion of the device taken along the line III—III of FIG. 1.
Figure 4:
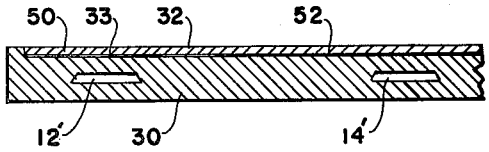
FIG. 4 is a sectional view of a portion of the device taken along line IV—IV of FIG. 1.

With regard to FIGS. 1, 2 and 3, a board 10 is seen with pairs of inventory tracks 12, 14 along each of which an individual inventory marker strip 16, 18 respectively may be moved. An inventory marker scale 20 is located between each pair of tracks 12, 14 and marked with numerical indicia 21 or other quantitative indicia.

Tracks 12, 14 each extend as enclosed grooves 12', 14' in the left hand side 30 of the board under the surface 33 on which labels 32, 34, 36 may be affixed to indicate, for a specific pair of tracks 12, 14 and associated scale 20 and strips 16, 18, a product category on label 32, a brand name on label 34 and a unit size container on label 36.

Each track 12, 14 extends on the right hand side of the board 40. Undercut grooves open to the surface 41 which is stepped on a plane lower than the plane of surface 33.

Each strip 16, 18 is formed of a tongue section 45 shaped to matingly fit in a groove 12', 14' respectively on a track 12, 14 which tongue section is joined on its right end to a head section 47 that projects above the surface 41 adjacent a track 12, 14. Preferably, the top surfaces of each head section and tongue section is distinctively colored to contrast with the background surface 41 and each other.

Tracks 12, 14 each extend to the right hand edge of board 10 so that each strip 16, 18 may be completely slid off from a track or replaced so that strips of selected colors may be employed.

Preferably, one strip 16 is employed to indicate the actual inventory in stock of a given item with the associated strip 18 employed to indicate the minimum quantity of stock that it is considered desirable to maintain in actual inventory.

In use, the upper strip 16 is moved leftwards, as units are removed from stock so that head 47 of strip 16 indicates on scale 20 the remaining quantity in stock of the item identified by labels 32, 34, 36 of the associated horizontal row on the board. When head 47 of strip 16 meets head 47 of strip 18, the device indicates to the user the necessity of reordering the specific product identified by the labels of the associated horizontal row. Strip 16 is moved to the right, when initially setting up the board, so that head 47 of strip 16 against scale 20, indicates the quantity of inventory in stock, with strip 16 being moved subsequently proportionately to the right to reflect additional purchases or deliveries of the identified item.

Labels 32, 34, 36 may be bound to a pad 50 which is formed of a plurality of sheets of such labels, such that the top sheet of the pad 50 may be removed and serve as notification of the need to reorder the product listed on the sheet. Each such sheet may contain all three labels 32, 34, 36 or each pad may contain sheets of only a specific label 32, 34, 36. The undersurface of each pad may be coated with adhesive 52 so as to detachably adhere to surface 33.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. An inventory board, comprising:

a board, a first section of which is formed with a surface on which a label can be attached, with said board formed with a second section fitted with indicating means to identify numerical values such as inventory quantities, wherein the means to identify a numerical value of the indicating means is a slidable marker movable in an undercut track along the board, together with a marker scale fixed to the board, said track extending in said second section along an axis that intersects said first section so that a label may be attached to the surface of said first section in proximity to said axis to serve as indentification means for the slidable marker, with the marker scale fixed on the said second section adjacent said track, wherein the board has a plurality of pairs of such tracks, each track fitted with a first or second selective movable marker, each having a pointer-like head portion and with a common marker scale located between each pair of said tracks serving as the indicating means, with said tracks and marker scales each oriented along parallel axes, one of said first and second markers pre-set to indicate a selected reference numerical quantity of an item, which item is an item of stock, and the other marker movable to indicate an actual numerical quantity of said item that is in stock at the present time, based on actual current sales and purchases of that item.

2. The combination recited in claim 1, in which said tracks are in the form of undercut grooves, open to the surface of the second section of the board and each extending as a shaped hole under the surface of the first section of the board, such that the top surface of each marker is visible only for the length of the marker that extends in an open groove in the said second section.

3. The combination as recited in claim 2 in which a head section is mounted on each marker, said head section extending above the surface of the said second section, and said marker and head section of a cross-section that is greater than the cross-section of the groove that extends in the first section of the board of the track in which the marker is mounted, with said head section serving as an indicator to identify a specific quantitative indicator of a marker scale that is adjacent to the track of the marker.

4. The combination as recited in claim 3, in which each track extends to a free edge of the second section so that a marker may be removed or replaced in said track by sliding said marker across said free edge.

* * * * *